United States Patent [19]

Laimer et al.

[11] 4,143,864

[45] Mar. 13, 1979

[54] HOOD ARRANGED ON A BLOWING STAND COMPRISING A TILTABLE CONVERTER

[75] Inventors: Friedrich Laimer, Perg; Herbert Herrmann, Linz, both of Austria

[73] Assignee: Vereinigte Osterreichische Eisen- und Stahlwerke-Alpine Montan Aktiengesellschaft, Linz, Austria

[21] Appl. No.: 871,501

[22] Filed: Jan. 23, 1978

[30] Foreign Application Priority Data

Feb. 4, 1977 [AT] Austria ..... 717/77

[51] Int. Cl.[2] ..... C21C 5/38

[52] U.S. Cl. ..... 266/158

[58] Field of Search ..... 75/60; 98/115 R, 115 VM; 266/142, 143, 158

[56] References Cited

U.S. PATENT DOCUMENTS

| | | | |
|---|---|---|---|
| 3,791,638 | 2/1974 | Evans | 266/158 |
| 3,938,788 | 2/1976 | Josten | 98/115 R |
| 4,049,246 | 9/1977 | Ziegler | 266/158 |
| 4,072,299 | 2/1978 | Calderon | 266/158 |

*Primary Examiner*—Gerald A. Dost

*Attorney, Agent, or Firm*—Brumbaugh, Graves, Donohue & Raymond

[57] ABSTRACT

A hood arranged at a blowing stand of a steel making plant for diverting the smoke and flue gases emerging during charging of a converter, totally covers the converter mouth at a vertical distance thereabove so as to leave room for the charging container, and includes closeable recesses, into and out of which the carrying devices of a crane guiding the charging container can be moved.

13 Claims, 4 Drawing Figures

HOOD ARRANGED ON A BLOWING STAND COMPRISING A TILTABLE CONVERTER

BACKGROUND OF THE INVENTION

The invention relates to a hood, arranged on a blowing stand of a steel making plant comprising a tiltable converter, for diverting the smoke and flue gases, emerging during charging of the converter. The charging material is pour into the converter, which is tilted into the inclined charging position, with the help of a charging container that is displaceable by means of a crane.

When charging a converter with scrap and/or pig iron, smoke and flue gases will emerge from the converter. Due to the inclined position of the converter during charging, the flue gases cannot be seized by the principal chimney flue that serves for the diversion of the flue gases during the blowing procedure. The high gas temperatures during charging lead to a strong buoyancy, the flue gases and the smoke rapidly rising up to the roof where they emerge through openings into the open air, thus constituting a nuisance for the environment.

Hoods for collecting the flue gases emerging during charging can be designed only up to a certain size for operational reasons, particularly because it is necessary that the crane approach the converter during charging. Consequently, these hoods have proved too small in operation and the larger part of the flue gases can not be seized, thus escaping beside the hood.

SUMMARY OF THE INVENTION

The invention aims at avoiding these disadvantages and difficulties and has as its object to create a hood with which the flue gases emerging from the converter during charging are almost totally seized and controlled, for instance by being conducted away via a filter or a dedusting plant, and which allows the indoor crane to be displaceable into the charging position without hindrance.

This object is achieved according to the invention in that the hood totally covers the mouth of the converter from a vertical distance above it, when the vessel is in the charging position so as to leave room for the charging container. The hood comprises at least one lateral closeable recess, into and out of which carrying devices of the crane guiding the charging container can be moved.

Advantageously, the hood comprises vertical side walls, as well as a cover plate connecting the side walls, and a flue pipe ending in the cover plate or the side wall.

According to a preferred embodiment the hood is stationarily arranged below the craneway and comprises two recesses, into and out of which the carrying ropes of the crane holding the charging container can be moved.

In this case, the recesses are suitably closeable with wings displaceable along a side wall of the hood.

An advantageous further development of this embodiment is characterized in that the recesses penetrate a side wall, reach into the cover plate, and are each closeable by an L-shaped wing. One leg of the wing contacts the cover plate and the other leg contacts the side wall, the leg contacting the cover plate being designed so as to leave free a part of each recess for the ropes of the crane.

A further preferred embodiment is characterized in that it covers the crane bridge end facing the converter, and that a trolley moving the charging container to above the mouth of the converter is moveable into the hood via the recess. A cover plate corresponding to the recess is fastened to the trolley so that the cover plate closes the recess of the charging container when in the charging position.

Suitably the hood, in this case, is fastened to the crane bridge and is displaceable with the same.

For better seizing of the flue gases, guiding plates are arranged on the crane bridge, thereby elongating the vertical side walls of the hood.

In a crane having two trolleys suitably the cover plate, at its lower parts, is elongated by a chain screen, whereby, on the one hand, the flue gases can be seized better, and, on the other hand, a lower trolley can move along the crane bridge below the first trolley without hindrance.

Preferably, a mesh grating is arranged at the lower side of the crane or hood, which prevents flames from striking high up.

For sucking off the flue gases, the hood, on its upper side, has at least one opening which is in alignment with stationary flue pipes when the crane bridge is in the charging position.

BRIEF DESCRIPTION OF THE DRAWING

The invention will now be explained in more detail by way of two embodiments and with reference to the accompanying drawings, wherein.

DESCRIPTION OF EXEMPLARY EMBODIMENTS

Figure 1:
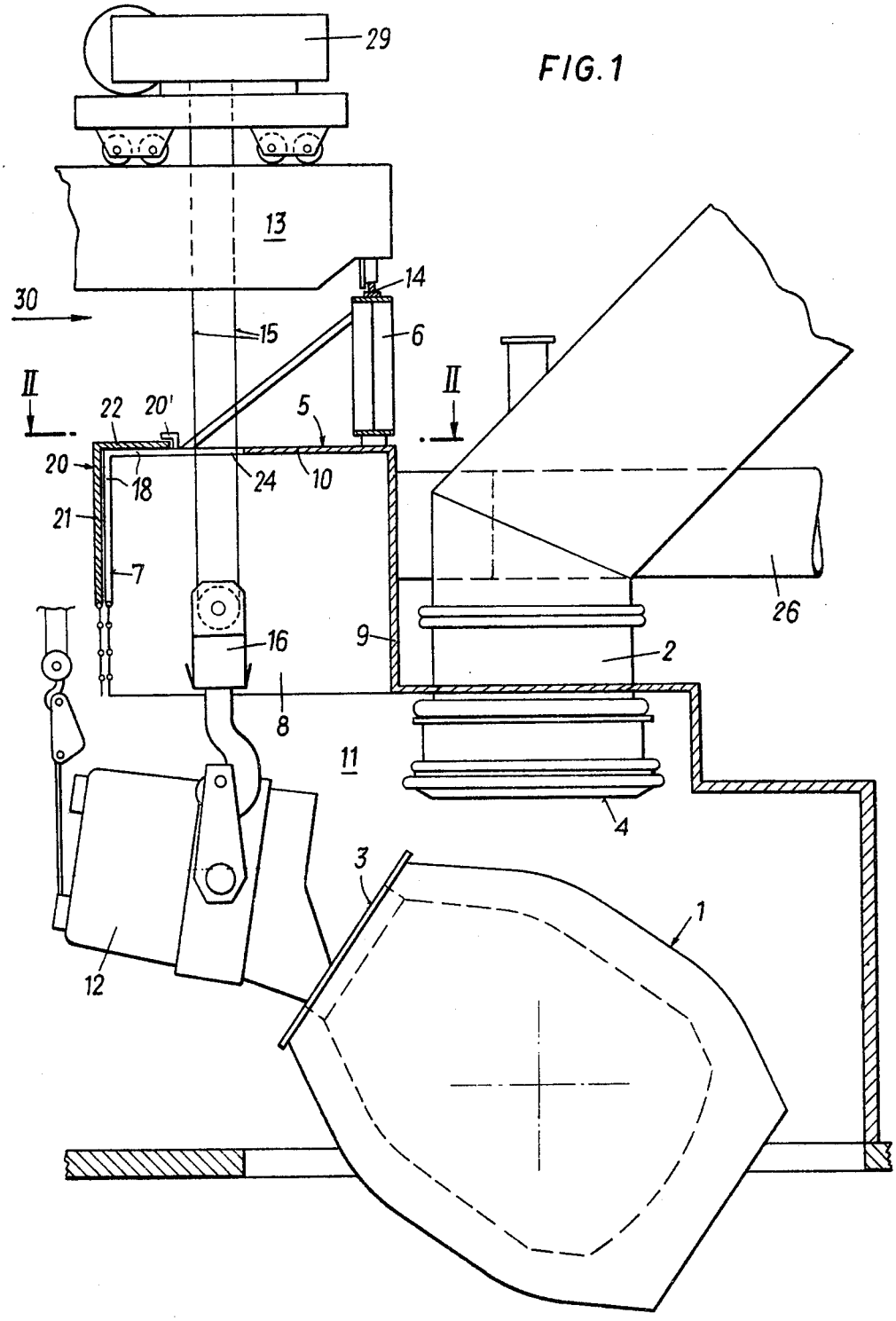
FIG. 1 is a schematic illustration in vertical section of one embodiment of the hood during charging.
Figure 2:
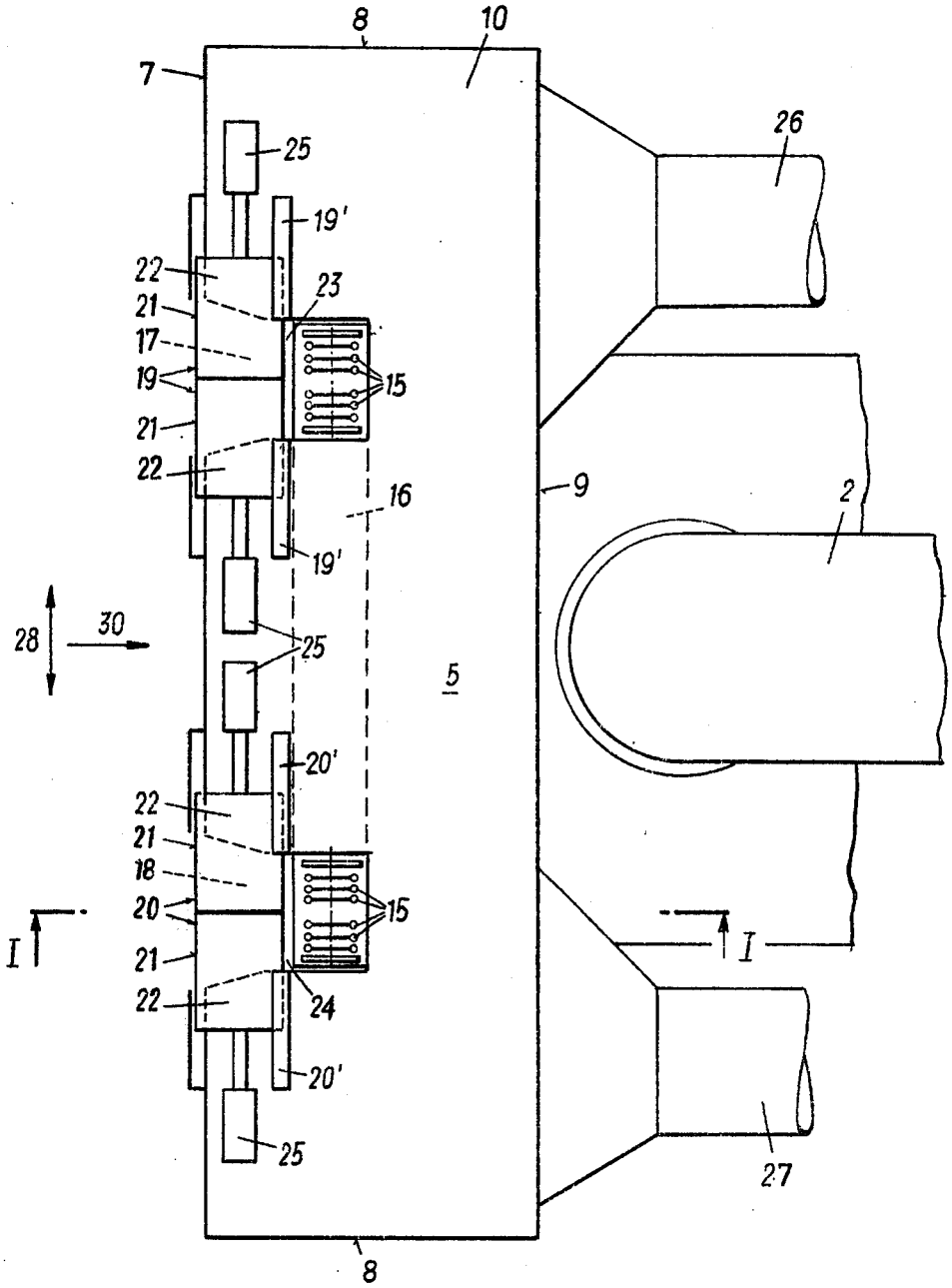
FIG. 2 is a section along line II—II of FIG. 1.

In FIG. 1 a converter 1 is tiltably mounted below a main chimney flue 2 that serves for sucking off the flue gases formed during the blowing procedure. For charging, the converter is tilted into the position illustrated in FIG. 1, its mouth 3 thus being displaced to the side of opening 4 of the main chimney flue. Above the mouth 3 of the tilted converter 1, a hood 5 totally covering the mouth is stationarily mounted to the hall structure 6. The hood 5 has vertical side walls (7, 8, and 9) and a cover plate 10 connecting the side walls. It is located above the converter mouth at such a distance that a charging container 12 — a pig iron ladle according to FIG. 1 — can be moved by a crane 13 into the free space 11 between the hood 5 and the converter mouth 3. The crane 13 is displaceable above the hood along rails 14 in the longitudinal direction of the hall. As can be seen particularly from FIG. 2, lateral recesses (17, 18) are provided in the hood 5 for ropes 15 of the crane tie-bar 16, which recesses each penetrate one side wall 7 facing away from the converter and extend into the cover plate 10.

Both recesses (17, 18) are each closeable with two-part L-shaped plates, i.e. wings (19, 20), one leg 21 of which contacts the side wall 7 and the other leg 22 contacts the cover plate 10. Each leg 22 contacting the cover plate is shorter than the recesses (17, 18) extending into the cover plate, so that free openings (23, 24), which cannot be covered by the wings (19, 20), are formed for the ropes 15 of the crane tie-bar 16.

Displacing the wings (18, 19) is effected by means of adjustment devices 25, preferably hydraulically or pneumatically operable pressure-medium cylinders. However, electrically operable adjustment drives could also be provided. Guides (19', 20') facilitate sliding of the wings during opening and closing of the recesses.

Flue pipes (26, 27) enter into the side wall 9 facing the converter 1 at its ends near the side plates 8 of the hood 5, which flue pipes are led to a dedusting plant as well as to a ventilator (not illustrated), and extend past the main chimney flue 2 on each side thereof. The flue pipes 26 and 27 can also be engaged in the side plates 8.

The function of the hood is the following: The crane 13 is moved with the pig iron ladle 12 (or with a scrap chute) a point exactly above the converter center in the direction of the arrows 28 of FIG. 2. A sign on the craneway facilitates this. Then a trolley 29 together with the charging container hanging on the crane suspension 16 is moved in the direction of the arrow 30 towards the converter 1, until the charging position is reached. The carrying ropes 15 of the crane tie-bar 16 in this case are in the openings 23 and 24 of the hood 5. Now the recesses (17, 18) are closed by the wings (19, 20) by means of the adjustment drives 25. Then the charging procedure will take place after the flue pipes (26, 27) have been put into operation. Suitably the moving mechanisms of the crane 13 are locked during charging in dependence on the position of the wings, so that moving of the crane tie-bar 16 when the recesses (17, 18) are closed, is not possible, either in the direction of the arrows 28 or in the direction of the arrow 30.

Figure 3:
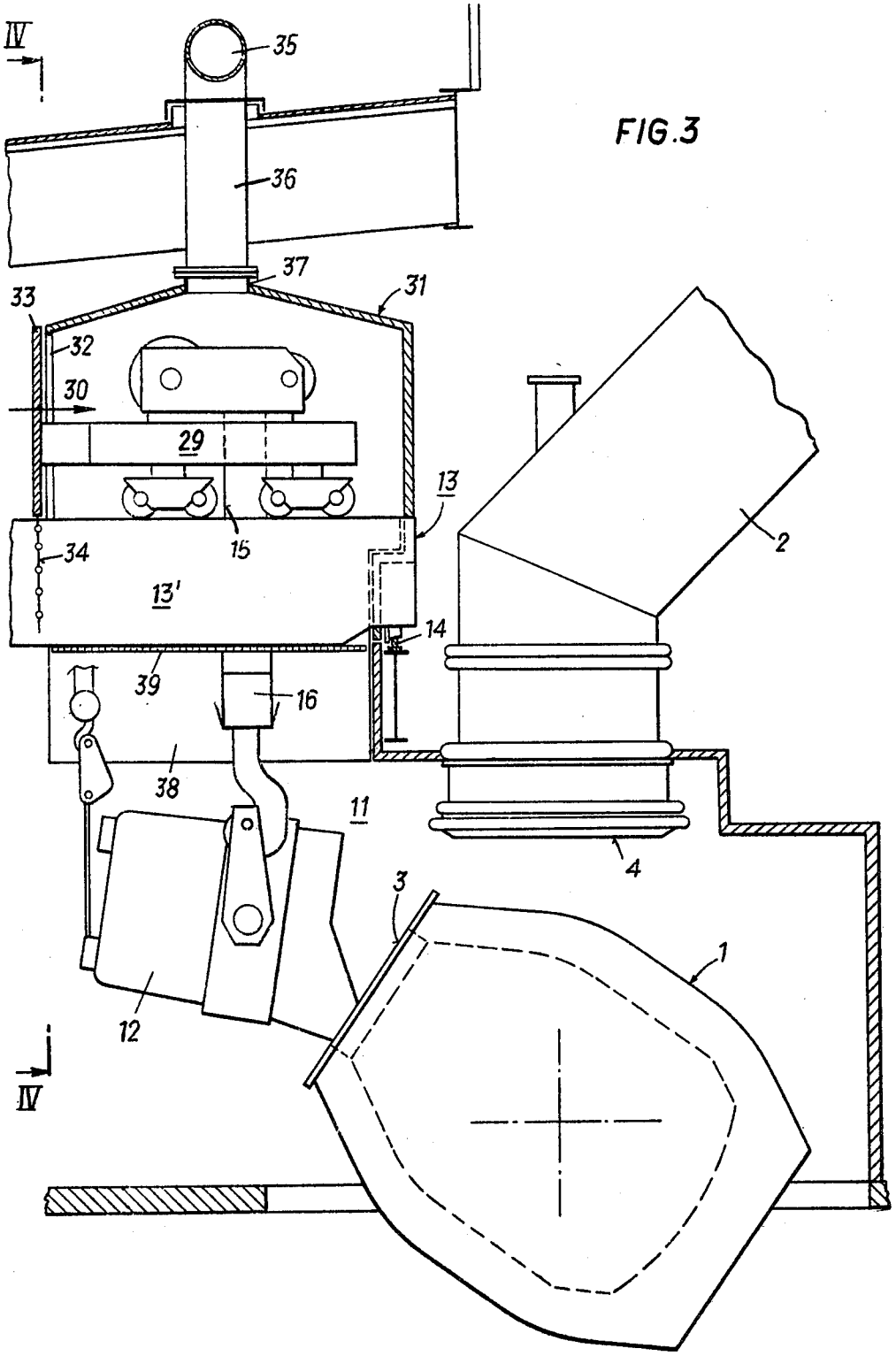
FIG. 3 illustrates another embodiment analagous to the illustration in FIG. 1.
Figure 4:
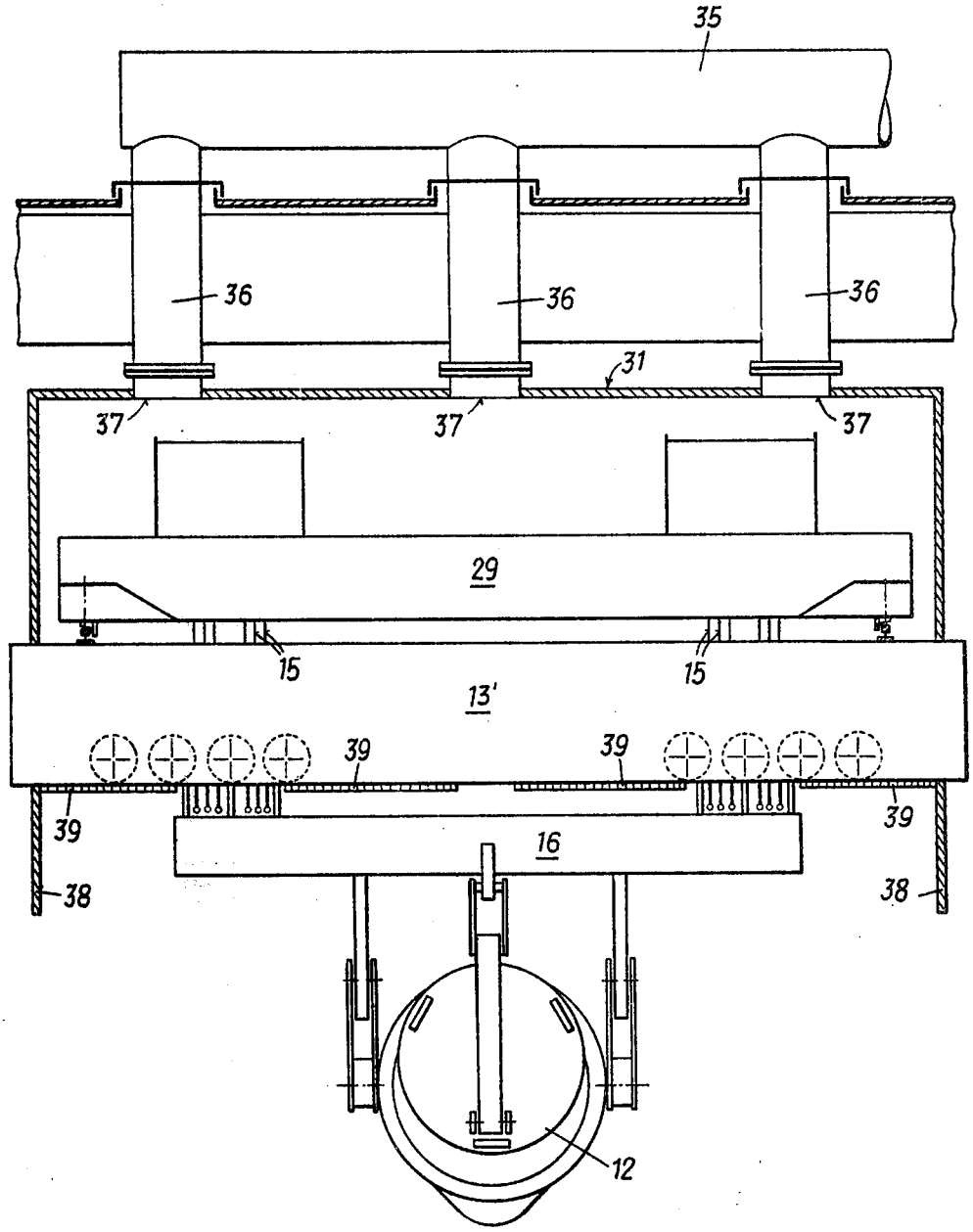
FIG. 4 is a section along line IV—IV of FIG. 3.

FIGS. 3 and 4 represent a further embodiment of a hood 31 according to the invention, which is arranged on that end of a crane bridge 13' that faces the converter, thus being displaceable together with the crane. It has a recess 32, through which the trolley 29 carrying the charging container via the tie-bar 16 can be moved in and out. For closing the recess 32 a cover plate 33 is attached to the trolley 29, which plate closes the recess 32 as shown in FIG. 3, when the trolley has moved below the hood into the charging position. The cover plate 33 is elongated on its lower part by a chain screen 34. With this arrangement the flue gases can be seized better and it is possible to provide, below the trolley carrying the charging container, a further trolley displaceable along the crane bridge.

Above the hood a flue pipe 35 leading to a filter and a ventilator is provided, which pipe 35 has three flue connection pieces 36 extending perpendicularly downwards (FIG. 4). The hood 31 comprises openings 37 corresponding to the flue connection pieces 36 and, once the crane bridge has been brought into the charging position, the openings 37 are in alignment with the flue connection pieces 36, thus ensuring the sucking off of the flue gases flowing into the hood. Guiding plates 38 elongating the side walls of the hood 31 are arranged on the crane bridge 13', so that the flue gases can be seized better. A mesh grating 39 made of metal is mounted to the lower side of the crane, thereby preventing flames from striking high up.

Charging of the converter with pig iron or scrap is effected in the following way: The crane is moved with the ladle 12 or a chute to a point exactly above the middle of the converter. In that position, the openings 37 of the hood 31 are exactly below the flue connection pieces 36. The trolley 29 is moved with the ladle or chute in the direction toward the converter and into the hood in the direction of the arrow 30, until the charging position is reached; in that position, the cover plate attached to the trolley closes the recess. Then the charging procedure starts. The emerging gases are completely seized by the hood and led to the filter via the flue pipe 35.

The invention is not limited to the embodiments described with reference to the figures, but can be modified in various aspects. Thus, it would, for instance, be possible with the embodiment represented in FIGS. 3 and 4 to stationarily mount the hood similar to the embodiment illustrated in FIGS. 1 and 2, the cover plate and the plates arranged to the side of the trolley being mountable to the trolley. The upper side of the hood comprising the flue openings 37 in that case should be connected to the flue connection pieces 36 and fastened to the roof construction.

What we claim is:

1. In a hood to be used for diverting smoke and flue gas emerging during charging of a tiltable converter of a steel making plant with a charging material, the steel making plant including a blowing stand for the tiltable converter, a crane arranged above the converter, and a charging container movable by said crane, the tiltable converter having a mouth and being tilted when in an inclined charging position while the charging material is poured from the charging container into the tiltable converter, the improvement characterized in that:

said hood is arranged to totally cover said mouth of said tiltable converter when the converter is in the charging position, said hood being at such a vertical distance thereabove that free space for the charging container is created within the hood adjacent the mouth of the converter;

said hood is provided with at least one closeable, laterally located recess, said recess being closeable during charging of the converter; and carrying devices are mounted on the crane for carrying and moving the charging container, along with at least part of said carrying devices, into and out of said at least one closeable recess and the free space adjacent the converter mouth.

2. A hood as set forth in claim 1, wherein said hood includes vertical side walls, a cover plate connecting said side walls, and at least one flue pipe ending in said cover plate.

3. A hood as set forth in claim 1, wherein said hood includes vertical side walls, a cover plate connecting said side walls, and at least one flue pipe ending in one of said side walls.

4. A hood as set forth in claim 1, wherein said crane is moveable along a craneway and said hood is stationarily arranged below said craneway and is provided with two closeable recesses, said carrying devices mounted on the crane being designed as carrying ropes.

5. A hood as set forth in claim 4, wherein said hood includes side walls and a cover plate connecting said side walls, and wherein wings are provided, said wings being movable along one of said side walls to close said two closeable recesses.

6. A hood as set forth in claim 5, wherein said two closeable recesses penetrate one of said side walls and reach into said cover plate, each of said wings provided for closing said two closeable recesses being L-shaped thus having two legs, one of said two legs of each wing contacting said cover plate and the other one of said two legs of each wing contacting said one of said side walls, said one of said two legs contacting said cover plate being designed so as to leave part of the respective one of said two closeable recesses free for said carrying ropes of said crane.

7. A hood as set forth in claim 1, wherein said crane includes a trolley and a crane bridge, and said crane bridge has an end arranged on the converter side, said hood covering the end of said crane bridge arranged on the converter side, and wherein said trolley moves said charging container into the hood via said at least one closeable recess to a position above the mouth of said converter, and a cover plate corresponding to said at least one closeable recess is fastened to said trolley, which cover plate closes said at least one closeable recess when said charging container is in the charging position.

8. A hood as set forth in claim 7, wherein said hood is fastened to said crane bridge and is movable together with said crane bridge.

9. A hood as set forth in claim 7, wherein said hood includes vertical side walls and guiding plates are arranged on said crane bridge, which guiding plates elongate said vertical side walls of said hood.

10. A hood as set forth in claim 7, further comprising a chain screen for elongating the cover plate at its lower part.

11. A hood as set forth in claim 7, further comprising a mesh grating arranged at the lower side of said crane, which mesh grating prevents flames from striking high up.

12. A hood as set forth in claim 7, further comprising a mesh grating arranged at the lower side of said hood, which mesh grating prevents flames from striking high up.

13. A hood as set forth in claim 8, wherein said hood, on its upper side, has at least one opening, and further including stationary flue pipes, said at least one opening being in alignment with said stationary flue pipes when said crane bridge is in the charging position.

* * * * *